United States Patent [19]

Antonious

[11] 4,296,558

[45] Oct. 27, 1981

[54] ADJUSTABLE AND FLEXIBLE CLOSURE ASSEMBLY FOR SHOES WITH SEGMENTED UPPERS

[76] Inventor: Anthony J. Antonious, 205 E. Joppa Rd., Towson, Md. 21204

[21] Appl. No.: 11,511

[22] Filed: Feb. 12, 1979

[51] Int. Cl.[3] ..... A43B 11/00

[52] U.S. Cl. ..... 36/50; 36/45; 36/102

[58] Field of Search ..... 36/50, 51, 54, 99, 102, 36/45; 2/DIG. 6; 24/204, 73 GC

[56] References Cited

U.S. PATENT DOCUMENTS

| | | | |
|---|---|---|---|
| 2,994,972 | 8/1961 | Blair | 36/45 X |
| 4,114,297 | 9/1978 | Famolare, Jr. | 36/50 |

FOREIGN PATENT DOCUMENTS

| | | | |
|---|---|---|---|
| 242557 | 9/1965 | Austria | 36/50 |
| 173924 | 9/1906 | Fed. Rep. of Germany | 36/50 |
| 579941 | 8/1924 | France | 36/50 |
| 2271782 | 12/1975 | France | 24/204 |
| 2375841 | 7/1978 | France | 36/50 |
| 430494 | 8/1967 | Switzerland | 36/50 |

*Primary Examiner*—James Kee Chi

*Attorney, Agent, or Firm*—Nicholas J. Aquilino

[57] ABSTRACT

A shoe having segmented upper sections, each section including a closure in combination with at least one adjustable and flexible closure assembly including an anchor means, fastener strap and multi-position flexible separable fastening means which permit the wearer, using only one hand, to independently control and maintain a precise tautness of the shoe.

11 Claims, 24 Drawing Figures

ADJUSTABLE AND FLEXIBLE CLOSURE ASSEMBLY FOR SHOES WITH SEGMENTED UPPERS

FIELD OF THE INVENTION

The present invention relates to improvements in both low-cut and high-cut footwear, particularly shoes for jogging, tennis, racket ball, basketball, running, wrestling, soccer, football and other action sports. Additionally, other types of shoes equally applicable include dress shoes, casual shoes, work shoes, boots and other adaptable footwear.

BACKGROUND OF THE INVENTION

Present sport shoes which use laces only for fastening means will yield or loosen when a force is exerted against them, even though minimal, and, therefore, do not maintain the original tautness applied by the wearer.

In my prior U.S. Pat. Nos. 4,079,527 and 4,126,951 and other copending applications, I disclose various Velcro type closures for fastening shoes. Other patents showing Velcro fastener on shoes are Canadian Pat. No. 935,640 to Lupien and U.S. Pat. Nos. 3,626,610 to Dassler, 3,618,325 to Cary and 4,081,916 to Salisbury, among others.

U.S. Pat. No. 3,546,796 to Adams discloses a sport shoe featuring a divided vamp with separate upper and lower vamp sections, each section utilizing laces to secure the shoe.

However, the shoes utilizing Velcro type closures referred to above are not constructed to function in combination with segmented uppers which form upper and lower vamp sections. Furthermore, the Adams shoe uses laces only in both the upper and lower divided vamp sections with no suggestion of a flexible and adjustable Velcro type closure assembly.

THE PRESENT INVENTION

This invention relates to improvements in footwear which can totally or partially eliminate the use of laces as a fastening means for sports shoes and other types of shoes. Specifically, this invention refers to an improved adjustable and flexible closure assembly which offers the multiple advantages of a custom fit, more support, a reliable fastener to firmly secure the shoe to the foot as well as provide maximum comfort. This applies whether the wearer has a high, medium or low instep or has a wide, medium or narrow foot. Further, this closure assembly is applicable to shoes made of flexible, light weight materials, such as canvas, soft leather, nylon and the like, for such shoes made for jogging, tennis, basketball and running, as well as shoes made of more durable materials, such as leather, vinyls and the like, for soccer, football, baseball, track, work, dress, camping and other footwear.

The improvements of this invention permits a better shoe construction which offers more safeguard features with increased protection to minimize major causes of foot injuries and discomfortures.

Unlike prior art shoes where laces loosen during use, when a force is exerted in a shoe utilizing the adjustable and flexible closure assembly of this invention, the original tautness applied will not slacken or loosen. This is possible because of the sturdy construction of the closure assembly, preferably made of leather, vinyl, nylon, canvas or other durable strapping materials, combined with the closure assembly straps being permanently attached to the shoe and utilizing hook and loop Velcro type fastening means.

The closure assembly surrounds the specific foot areas considerably more than laces, thereby providing and maintaining more tautness than possible with laces alone. Additionally, the substantial bracing and supporting action of the closure assembly helps to keep the foot bones, tendons, ligaments, etc., in their normal position for maximum protection especially during quick movements in fast action sports which provides a measure of safety not afforded by laced shoes.

The shoes of the present invention have uppers segmented to form upper and lower vamp sections on each side of the shoe with independent fastening means for each section. The segmented uppers may be overlapping or separated sections.

The improvement of this invention permits the wearer to independently adjust and fasten the adjustable and flexible closure assembly in the upper vamp section to the precise desired tautness for the specific area of the foot, such as the ankle, instep and waist portion of the foot. Utilizing laces in the lower vamp section, the wearer can also independently adjust and fasten the lower vamp section of the shoe to the desired tautness.

The adjustable and flexible closure assembly includes an anchor means formed on one side of the shoe, having an opening, D-ring (with or without roll bar), grommet or connector plate, which engages the fastener strap formed on the opposite side of the shoe. The fastener strap includes hook and/or loop Velcro-type fastening means permitting the shoe to be easily adjusted and fastened at the precise tautness desired by the wearer. An elastic means may be used in the closure assembly to permit increased flexing action for additional comfort.

Alternatively, the laces may be replaced by a second adjustable and flexible closure assembly in the lower vamp section to independently adjust and maintain the precise desired tautness across the toes and ball of the foot to avoid cramping the toes.

Among the objects of the present invention are to provide a shoe having an adjustable and flexible closure assembly which offers more safeguard features, minimizes foot discomforture, secures more firmly to the foot, better individual fit for each foot, as well as provide more comfort to the feet of the wearer.

DESCRIPTION OF THE PREFERRED EMBODIMENTS

Figure 1:
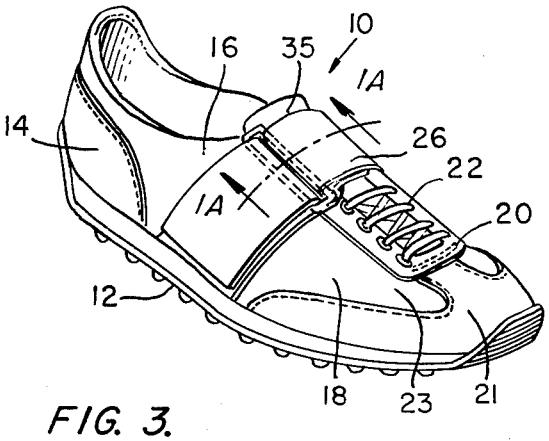
FIG. 1 is a perspective view of one embodiment of the present invention.
Figure 2:
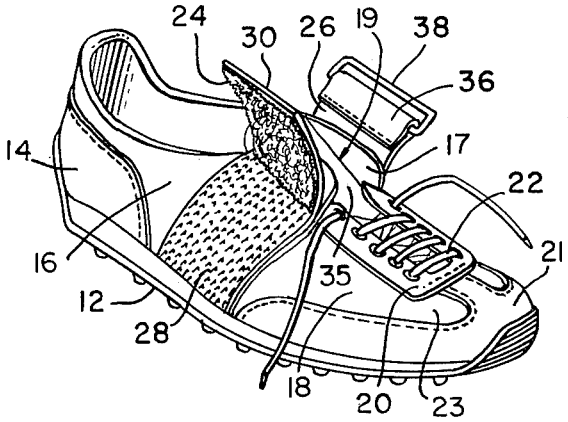
FIG. 2 is another view of the shoe of FIG. 1.
Figure 1A:
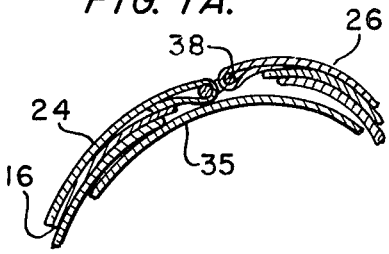
FIG. 1*a* is a sectional line taken along lines 1*a*—1*a* of FIG. 1.

FIGS. 1, 1*a* and 2 illustrate one embodiment of a low-cut shoe 10, such as a tennis or running show. The shoe 10 includes a sole 12 and uppers 14 which are segmented forming an upper quarter section 16 and a lower section 18. The upper quarter section 16 overlaps the lower section 18. Each of the upper and lower sections include separate fastening means to independently adjust and fasten each of the sections as described hereinbelow.

The upper quarter section 16 includes a vamp part 17 adjacent the shoe opening 19 above the tongue 35. The lower section includes a two-piece vamp structure including an opened vamp 20 which extends from the toe portion 21 part way up the shoe and ends just below the lower edge of the vamp part 17 on the upper section. The lower section further includes a vamp 23 positioned adjacent the toe portion 21 and the opened vamp 20. Laces 22 provide independent fastening of the lower section of the shoe just above the toe area of the foot of the wearer.

The upper quarter section 16 of the shoe utilizes an adjustable and flexible closure assembly which provides independently controlled fastening means for the upper section. The closure assembly utilizes a flexible, multi-adjustable, separable fastener having first and second fastening members including an array of complementary, coacting, flexible gripping elements on each of the members, for example, such as Velcro-type hook and loop separable fasteners. The closure assembly includes a fastener strap 24 and an anchor strap 26 which overlaps the upper section 16 on both sides of the shoe. The straps 24 and 26 are attached adjacent the sole 12 of the shoe 10 in a position to provide support at the arch of the wearer's foot and are secured over the shoe opening 19 above the wearer's instep. Preferably, the closure assembly is positioned on the upper section so that the lower edge of the straps 24 and 26 are adjacent the lower edge of the vamp 17 on the upper section 16 so that a substantial portion of the upper section 16 is covered by the straps on each side of the shoe opening 19. The fastener strap 24 is provided with a fixed end 28 secured to the upper quarter section 16 by conventional means, such as stitching or the like, and a free end 30 which extends beyond the upper vamp part 17 on the upper section 16 of the shoe 10. One side of the fastener strap 24 is provided with a hook and loop Velcro type fastening means including a pad 32 of hook type material and a pad 34 of loop type material. The free end 36 of the anchor strap 26 includes a D-ring 38 which forms an opening in the end of the anchor strap 26 through which the free end 30 of the fastener strap 24 passes in order that the fastener strap may fold back upon itself to engage the hook and loop pads 32 and 34, thereby securing the upper section 16 of the shoe across the instep of the wearer. A tongue 35 spans the shoe opening 19 and underlays both the upper and lower sections 16 and 18 cushioning the foot from the closures.

The arrangement provides for independent fastening of each of the upper and lower sections of the shoe. After the laces 22 in the lower section 18 are secured, the free end 30 of the fastener strap 24 is passed through the D-ring 38. When the precise desired tautness in the upper section 16 is achieved, the fastener strap 24 is then folded back upon itself causing the hook and loop pads to engage.

Figure 3:
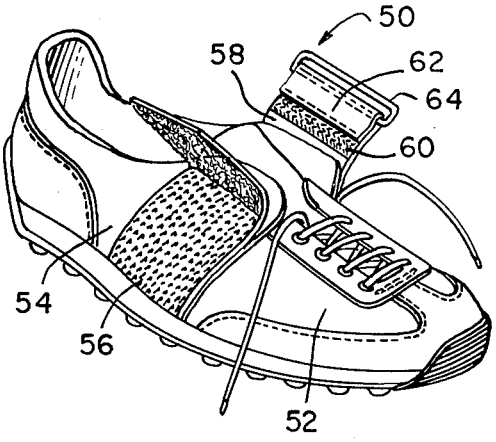
FIG. 3 is a perspective view of a second embodiment of the present invention.

FIG. 3 shows a second embodiment of the shoe 50 of the present invention. The shoe 50 also includes segmented uppers forming a lower section 52 overlapped by upper section 54. The upper section 54 includes an adjustable and flexible closure assembly formed of a fastener strap 56 and anchor strap 58. The shoe has essentially the same construction as the shoe shown in FIGS. 1 and 2 except that the anchor strap 58 is provided with an elastic section 60 between the end 62 of the anchor strap 58 and the point where it is secured back upon itself. This arrangement provides a degree of flexibility at that point once the fastener strap 56 is passed through the D-ring 64 and secured as described hereinabove. This flexibility allows for the natural expansion and flexing of the foot, particularly when the wearer is running or performing other strenuous activities.

Figure 4:
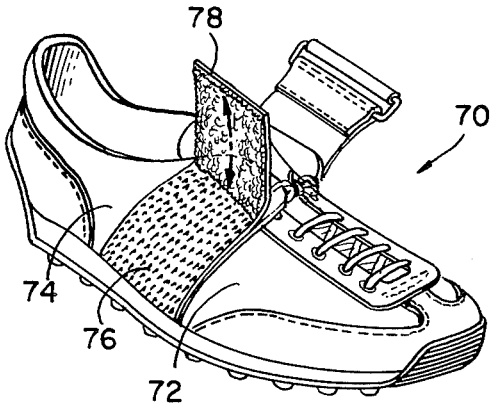
FIG. 4 is a perspective view of a third embodiment of the present invention.

FIG. 4 shows another embodiment of the present invention. A shoe 70 is the same type as described with reference to FIGS. 1 and 2 and includes segmented uppers forming a lower section 72 overlapped by upper section 74. The structure is the same with the exception of the fastener strap 76 which includes elasticized hook and loop fastening means 78 in place of the conventional hook and loop fastening means shown in FIGS. 1 and 2. This arrangement also provides a greater degree of flexibility for the foot.

Figure 5:
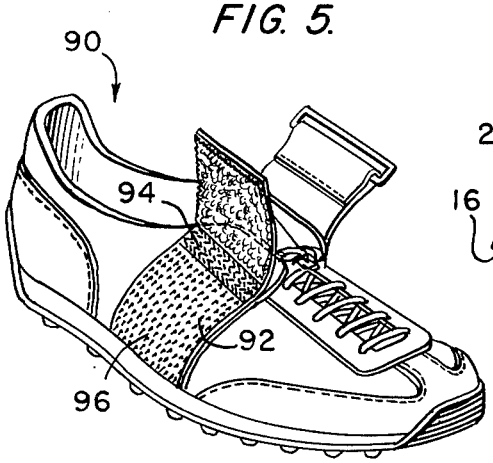
FIG. 5 is a perspective view of a fourth embodiment of the present invention.

FIG. 5 shows still another embodiment of the present invention. A shoe 90 has essentially the same structure as the shoes described hereinabove except that the fastener strap 92 is provided with an elastic section 94 between the hook pad 96 and the loop pad 98.

Figure 6:
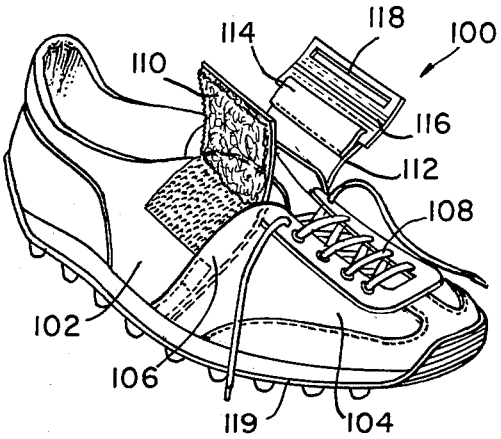
FIG. 6 is a perspective view of a fifth embodiment of the present invention.

FIG. 6 illustrates another embodiment of the present invention. A shoe 100 of the same general construction as the shoe of FIGS. 1 and 2 including segmented uppers forming an upper section 102 and a lower section 104. In this embodiment, the upper edge 106 of the lower section 104 overlaps the upper section 102. The lower section is formed with laces 108. The upper section 102 includes a flexible and adjustable closure assembly including a fastener strap 110 having a hook and loop fastening means and an anchor strap 112, the free end of which is secured to an opening 114 in a connector plate 116. A second opening 118 is adapted to receive the free end of the fastener strap 110 to secure the closure. In this embodiment, the fastener strap 110 is secured to the upper section 102 above the sole 119 of the shoe 100.

Figure 7:
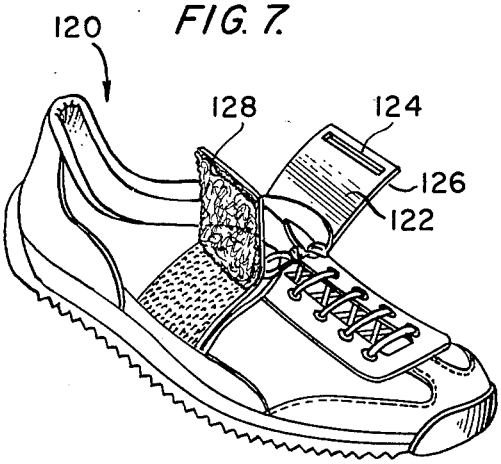
FIG. 7 is a perspective view of a sixth embodiment of the present invention.

FIG. 7 illustrates still another embodiment of the present invention. A shoe 120 has the same segmented upper construction as the shoe of FIGS. 1 and 2 except that the anchor strap 122 is provided with a grommet 124 at its free end 126. The grommet 124 is adapted to receive the fastener strap 128 to secure the closure assembly.

Figure 8:
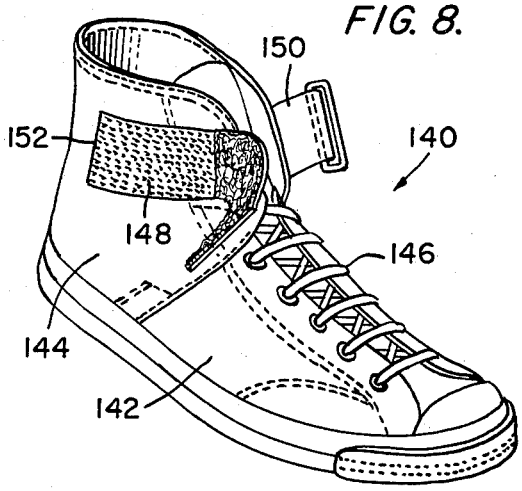
FIG. 8 is a perspective view of a seventh embodiment of the present invention.

FIG. 8 illustrates yet another embodiment of the present invention. A shoe 140 is a high-cut tennis or basketball type shoe having segmented uppers forming a lower section 142 overlapped by upper section 144. As with the embodiments described hereinabove, laces 146 are used to secure the lower section 142. The upper section 144 includes a flexible and adjustable closure assembly including a fastener strap 148 and an anchor strap 150. The fixed end 152 of the fastener strap 148 and the corresponding fixed end of the anchor strap 150 are secured to the upper portion of upper section 144 adjacent the ankle bone of the wearer. The closure assembly operates in the same manner as described hereinabove with respect to the previous embodiments. This arrangement offers considerable support and protection to the foot and especially the ankle during action play.

Figure 9:
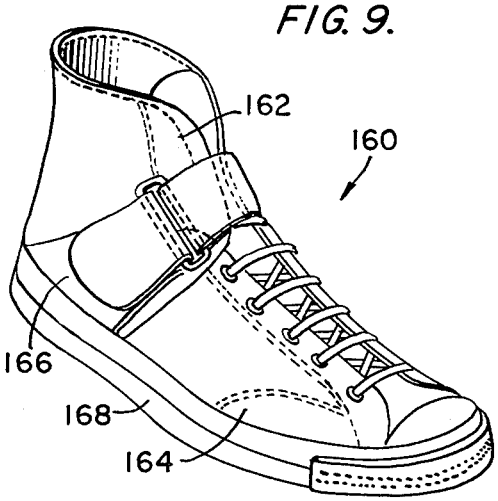
FIG. 9 is a perspective view of an eighth embodiment of the present invention.
Figure 10:
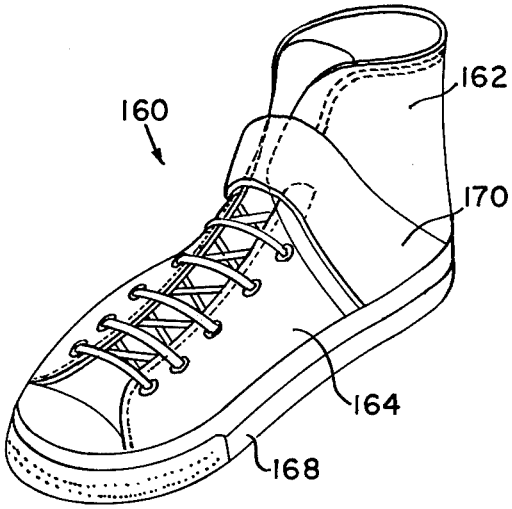
FIG. 10 is another view of the shoe of FIG. 9.

FIGS. 9 and 10 illustrate still yet another embodiment of the present invention. A shoe 160 is also a high-cut tennis or basketball type shoe having overlapping segmented uppers 162 and 164. The structure is essentially the same as the shoe in FIG. 8 except that the fixed end of the fastener strap 166 is secured to the shoe 160 where the segmented upper 162 and sole 168 adjoin. As illustrated in FIG. 10, the fixed end of anchor strap 170 is also secured to shoe 160 where the upper section 162 and sole 168 adjoin on the opposite side of the shoe.

Figure 11:
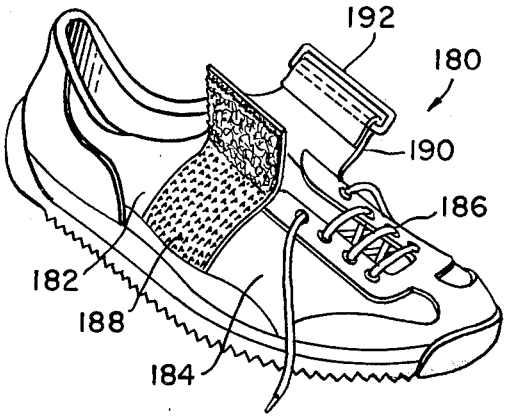
FIG. 11 is a perspective view of a ninth embodiment of the present invention.

FIG. 11 shows yet another embodiment of the present invention. A shoe 180 has overlapping segmented uppers forming an upper section 182 and a lower section 184. The lower section 184 uses laces 186. The upper section includes a flexible and adjustable closure assembly including a fastening member 188 which is integral with the upper section 182 forming an elongated extension. The upper section on the opposite side of the shoe includes an anchor member 190 formed by an elongated extension of the upper section 182. The anchor member 190 includes a D-ring 192 which receives the free end of the fastener member in order to secure the shoe as described hereinabove.

Figure 12:
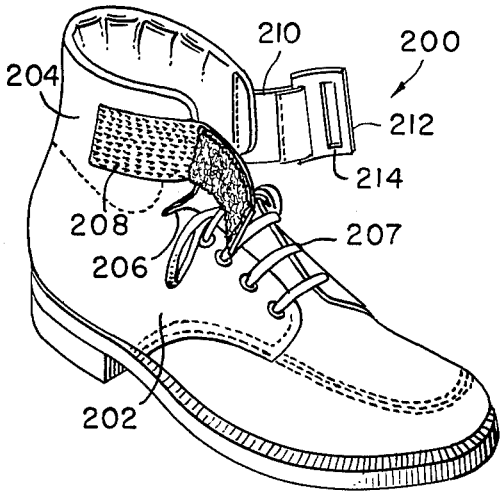
FIG. 12 is a perspective view of a tenth embodiment of the present invention.

FIG. 12 shows another embodiment of the present invention. A shoe 200 shows a further application adapted to a high-cut work-type shoe including segmented uppers defining a lower section 202 and an upper section 204 except the sections do not overlap but have a gap 206 between them. The lower section 202 includes a closure formed of laces 207. The upper section 204, adjacent the ankle, includes an adjustable and flexible closure assembly formed of a fastener strap 208 and an anchor strap 210 having a connector plate 212. The adjustable and flexible closure assembly is the same type as described with reference to the embodiments hereinabove and is secured by passing the fastener strap 208 through an opening 214 in the connector plate 212 and securing it back upon itself.

Figure 13:
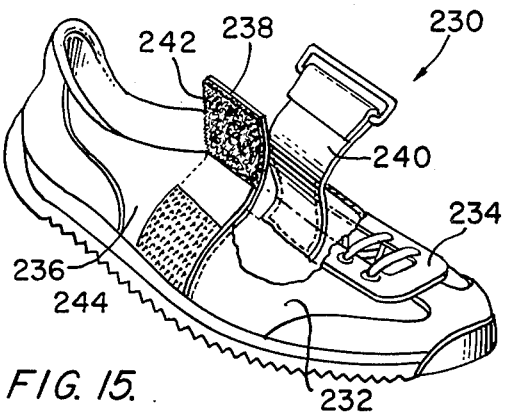
FIG. 13 is a perspective view of an eleventh embodiment of the present invention.

FIG. 13 shows yet another embodiment of the present invention. A shoe 230 formed of a lower section 232 having laces 234 and an upper section 236 having an adjustable and flexible closure assembly including a fastener strap 238 and anchor strap 240. In this embodiment, the straps 238 and 240 are formed of pieces of material which are secured to the inside of the shoe to provide additional support by embracing the foot. The fastener strap 238 includes a pad of loop type fastener material 242. A separate pad of hook type fastener material 244 is attached to the outside of the upper section 236 of the shoe 230.

Figure 14:
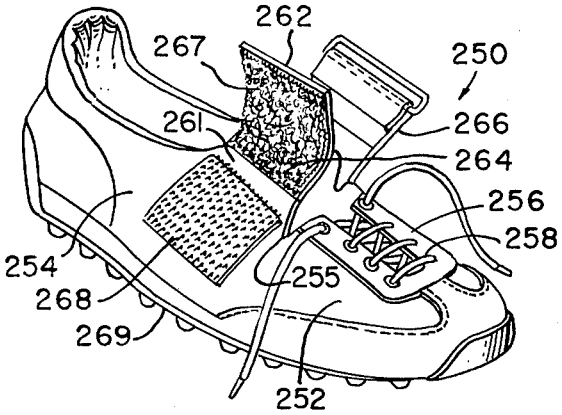
FIG. 14 is a perspective view of a twelfth embodiment of the present invention.

FIG. 14 illustrates another embodiment of the present invention. A shoe 250 is the same general type as described with reference to FIGS. 1 and 2 and includes segmented uppers defining a lower section 252 and upper section 254. The lower section 252 includes an open vamp 256 having laces 258. The upper edge 260 of the open vamp 256 is separated from the upper section 254 so that a gap 255 exists between the upper and lower sections. A fastener strap 262 is attached adjacent the edge of the vamp part 261 of the upper section 254 and engages an anchor strap 266. A pad 264 of loop type fastening material is provided on the fastener strap 262. A separate coacting pad 268 of hook type fastening means is separately attached to the upper section 254 of the shoe above the sole 269.

Figure 15:
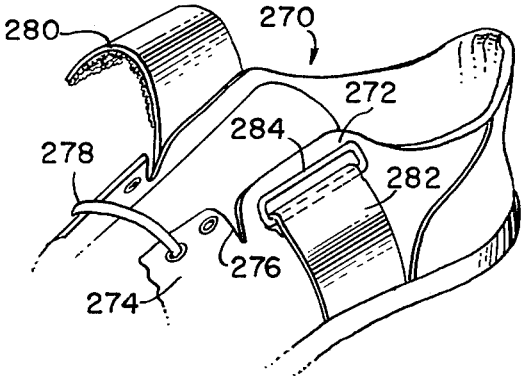
FIG. 15 is a partial perspective view of a thirteenth embodiment of the present invention.

FIG. 15 shows still another shoe 270 of the present invention having an upper section 272 and a lower section 274 which are separated by a gap 276. The shoe is similar to the embodiment described hereinabove. The lower section 274 includes laces 278 and the upper section includes a flexible and adjustable closure assembly having a fastener strap 280 and an anchor strap 282. The fastener strap 280 includes a hook and loop type fastening means and the free end of the anchor strap is provided with a D-ring 284. The fastener strap 280 is elongated and adapted to cross the shoe and engage the anchor strap 282 on the opposite side.

Figure 16:
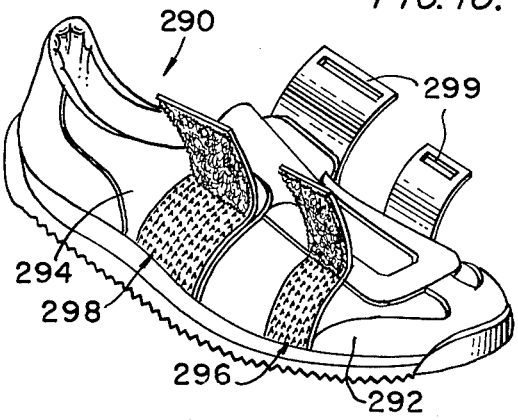
FIG. 16 is a perspective view of a fourteenth embodiment of the present invention.

FIG. 16 shows still another embodiment of the present invention. A shoe 290 has the same type construction as the shoes described hereinabove including segmented uppers forming a lower section 292 overlapped by an upper section 294. A flexible and adjustable closure assembly 296 having a grommet 297 is used in place of laces to secure the lower section 292. A second flexible and adjustable closure assembly 298 also using a grommet 299 secures the upper section 294 of the shoe 290. Both the closure assemblies 296 and 298 operate in the same manner described hereinabove to secure the shoe on the wearer's foot.

Figure 17:
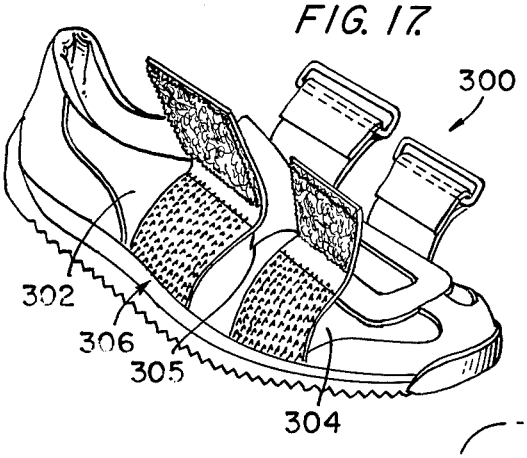
FIG. 17 is a perspective view of a fifteenth embodiment of the present invention.

FIG. 17 illustrates yet another embodiment of the present invention. A shoe 300 includes segmented uppers forming an upper section 302 and a lower section 304 wherein each of the sections 302 and 304 are separated and form a gap 305 between them. Each of the sections are provided with an adjustable and flexible closure assembly 306 and 308.

Figure 18:
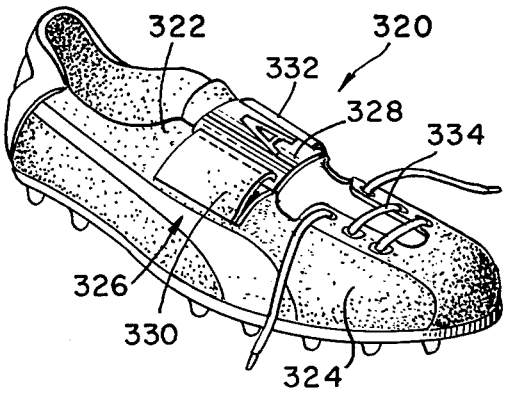
FIG. 18 is a perspective view of a sixteenth embodiment of the present invention.

FIG. 18 illustrates a football type of cleated shoe 320 having a segmented upper section 322 and a lower section 324. The upper section is provided with a flexible and adjustable closure assembly 326 including a connector plate 328 connecting the fastener strap 330 to the anchor strap 332. The lower section is provided with laces 334.

Figure 19:
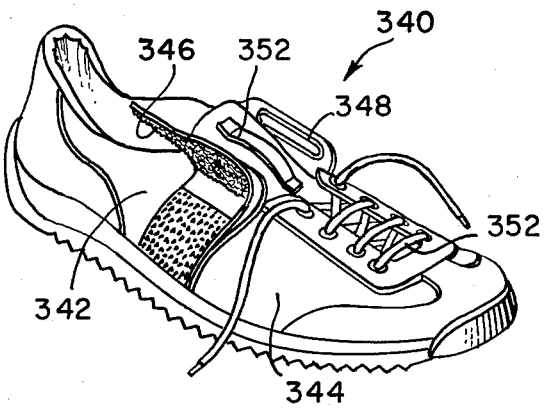
FIG. 19 is a perspective view of a seventeenth embodiment of the present invention.
Figure 20:
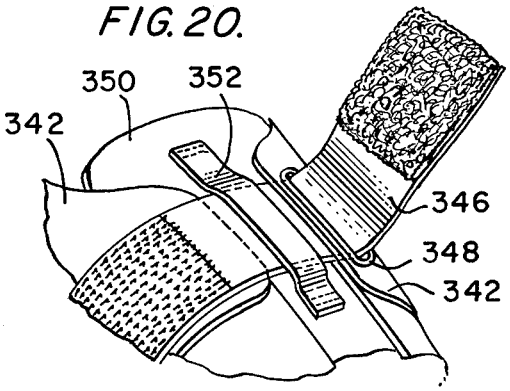
FIG. 20 is a view of a detail of a shoe of FIG. 19.

FIGS. 19 and 20 illustrate a shoe 340 having an upper section 342 which is segmented from and overlaps lower section 344. The upper section 342 includes an adjustable and flexible closure assembly formed of a fastener strap 345 and an anchor means in the form of a grommet 348 in the upper section 342 on the side of the shoe 340 opposite the fastener strap 346. The tongue 350 of the shoe 340 includes a loop 352 which maintains the tongue 350 in place when the closure assembly is secured. The lower section 344 is provided with laces 352.

Figure 21:
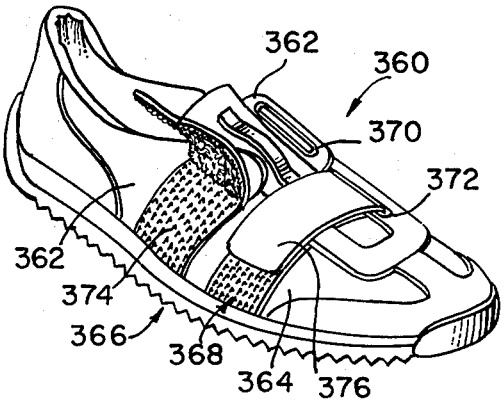
FIG. 21 is a perspective view of an eighteenth embodiment of the present invention.

FIG. 21 illustrates a shoe 360 having an upper section 362 and a lower section 364 which are segmented. The upper section 362 overlaps the lower section 364. Each section is provided with a flexible and adjustable closure assembly 366 and 368, respectively. Both the upper section 362 is provided with a grommet 370 and the lower section 364 is provided with a second grommet 372 to engage the fastener strap 374 and 376 of the closure assemblies 366 and 368.

Figure 22:
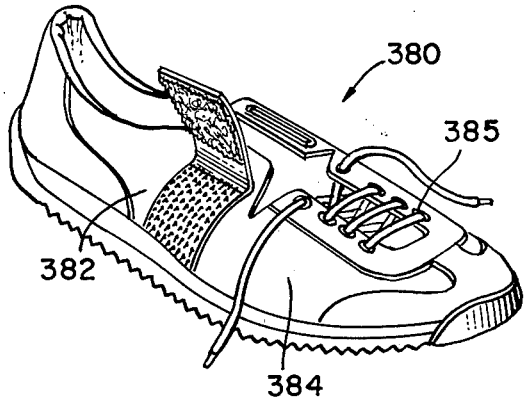
FIG. 22 is a perspective view of a nineteenth embodiment of the present invention.

FIG. 22 illustrates a shoe 380 having segmented uppers forming an upper section 382 and a lower section 384 which are separated. The lower section 384 includes laces 385 and the upper section 382 includes a flexible and adjustable closure assembly formed of a fastener strap 386 and a grommet 388 in the upper section 382 opposite the fastener strap 386.

Figure 23:
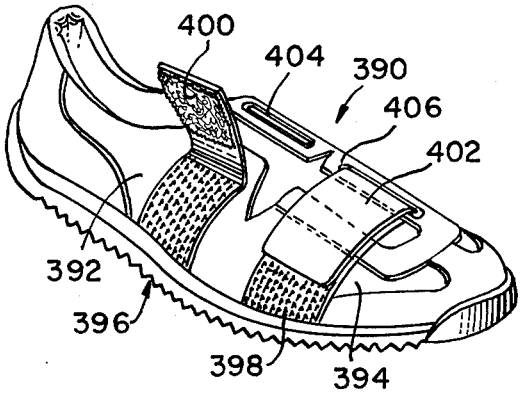
FIG. 23 is a perspective view of the twentieth embodiment of the present invention.

FIG. 23 shows a shoe 390 having segmented upper and lower sections 392 and 394 which are separated. Each of the sections 392 and 394 is provided with a flexible and adjustable closure assembly 396 and 398, respectively, including fastener straps 400 and 402 and grommet openings 404 and 406.

Figure 24:
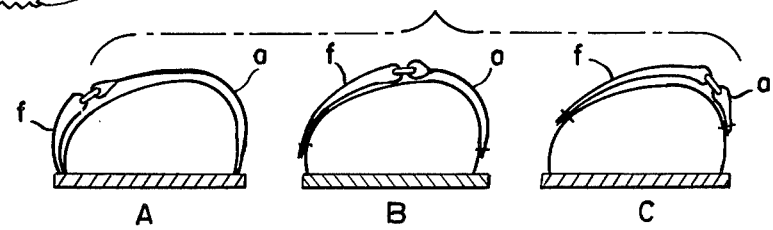
FIG. 24 shows three sectional views of various arrangements of the present invention.

FIG. 24 illustrates various arrangements which the closure may take when utilized on a shoe. FIG. 24*a* shows a fastener strap f, the fixed end of which is secured at the junction of the sole of the shoe and the shoe upper and which does not extend past the side of the shoe it is secured to. The anchor strap a is secured at the junction of the sole and the shoe upper on the other side and extends across the shoe to engage the fastener strap secured over the opposite side of the shoe. FIG. 24*b* illustrates a closure arrangement wherein the fastener strap and anchor strap both are attached above the sole of the shoe and extend partially across the shoe and engage. FIG. 24*c* illustrates a closure arrangement wherein the fastener strap is secured above the sole and extends across to the opposite side of the shoe. An anchor strap a is also connected above the sole but remains on that side of the shoe and engages the fastener strap.

These various arrangements in length and location of both the fastener strap and anchor strap are interchangeable and may be used on any of the embodiments shown in this application as long as the arrangement is consistent with that particular style of shoe.

In all of the above described embodiments, the use of an adjustable and flexible closure assembly in combination with a segmented shoe upper each having separate closure means provides the necessary tautness and adjustability to the shoe to make it comfortable while maintaining its security for a complete range of foot sizes of various wearers.

It will be appreciated that any of the above features may be interchanged with one another without departing from the scope of the present invention. Any suitable separable fastener including first and second fastening members having complementary, coacting, flexible gripping elements may be used in place of the hook and loop fastening means specifically described in the specification. Other changes may be made, for example, in either the fastener strap or the anchor strap or both, an elastic section may be used to provide greater flexibility. Various openings, such as a connector plate, grommet or D-ring, may be used in the shoes shown and are readily interchangeable. In addition, elasticized Velcro may be used to further increase the adjustability and flexibility of the closure assembly.

Other changes and modifications will become apparent in view of the following claims.

What is claimed is:

1. A shoe having a sole, uppers and an opening, said uppers being segmented to form upper and lower sections, each of said sections including a fastening means to independently adjust and fasten said sections, said upper section including a single fastener means formed of an adjustable and flexible closure assembly comprising:

a flexible, multi-adjustable, separable fastener means having first and second fastening members including arrays of complementary, coacting, flexible gripping elements for securing said closure assembly;

a fastener strap included on one side of said shoe having a fixed portion and a free end, said free end including said first fastening member, said second fastening member positioned adjacent said fixed portion of said fastener strap; and an anchor strap having a fixed portion and a free end, said free end having an opening, said fastener and anchor straps overlaying said upper section and having fixed portions being attached adjacent said sole of said shoe and located to support the arch of the wearer's foot whereby said free end of said fastener strap passes through said opening in said anchor strap permitting the shoe to be adjusted to the precise desired tautness across said upper section of said shoe.

2. The shoe of claim 1 wherein said upper section includes quarters on each side of said shoe and said quarters further include an upper vamp part adjacent said shoe opening.

3. The shoe of claim 1 wherein said lower section includes a lower vamp.

4. The shoe of claim 1 wherein said lower vamp is formed of a first part adjacent said shoe opening and a second part adjacent said first part.

5. The shoe of claim 1 wherein said anchor opening is a D-ring.

6. The shoe of claim 1 wherein said adjustable and flexible closure assembly forms said fastening means on said upper section, and said fastening means in said lower section is laces.

7. The shoe of claim 1 wherein the fixed end of said fastener strap is attached to said shoe where said uppers and said sole adjoin.

8. The shoe of claim 1 wherein said upper section of said shoe overlaps said lower section of said shoe.

9. The shoe of claim 1 wherein said quarters overlap said lower vamp section.

10. The shoe of claim 1 wherein said anchor strap crosses from a first side of said shoe to engage said fastener strap on the opposite side of said shoe.

11. The shoe of claim 1 wherein said straps overlaying said upper sections are positioned adjacent the lower edge of said upper section.

* * * * *